United States Patent [19]

Schwab

[11] Patent Number: 4,608,727

[45] Date of Patent: Sep. 2, 1986

[54] BURNISHING FLOOR POLISHER

[76] Inventor: Henry J. Schwab, W238 N6778 Laurie La., Sussex, Wis. 53089

[21] Appl. No.: 679,806

[22] Filed: Dec. 10, 1984

[51] Int. Cl.[4] ..... A47L 11/162

[52] U.S. Cl. ..... 15/98; 15/49 R; 51/177

[58] Field of Search ..... 15/50 R, 50 C, 49 R, 15/49 C, 98, 385; 51/175, 176, 177, 180; 29/90 R

[56] References Cited

U.S. PATENT DOCUMENTS

| | | | |
|---|---|---|---|
| 2,600,233 | 6/1952 | Finnell | 15/50 R |
| 3,407,422 | 10/1968 | Otto et al. | 15/49 R |
| 3,921,244 | 11/1975 | Warren et al. | 51/98 |
| 3,934,377 | 1/1976 | Tertinek | 51/177 |
| 4,122,576 | 10/1978 | Bevington et al. | 15/49 R |

FOREIGN PATENT DOCUMENTS

| | | | |
|---|---|---|---|
| 521297 | 1/1956 | Canada | 15/50 R |
| 0073725 | 3/1983 | European Pat. Off. | 15/49 R |
| 170521 | 3/1960 | Netherlands | 51/177 |

*Primary Examiner*—Edward L. Roberts
*Attorney, Agent, or Firm*—Andrus, Sceales, Starke & Sawall

[57] ABSTRACT

A burnishing floor polisher (2) includes a frame (4), an engine (6) mounted on the frame, and a rotary brush or pad (8) mounted through a universal joint (10) to a rotary shaft (12) supported from the frame, enabling flush engagement between the brush and the floor notwithstanding tilting of the frame. Left and right wheels (20, 22) on left and right axles (36, 38) support the frame for forward-rearward movement, and are adjustable forward-rearward relative to the frame for balancing the frame forward-rearward about the wheels as a fulcrum. A pulley and drive belt system (24) couple the engine to the rotary shaft for driving the rotary brush through the universal joint. An electromagnetic clutch (26) is provided for engaging and disengaging the coupling system from the engine. The disclosed subject matter is particularly characterized by its heavy grade durable construction minimizing down-time in industrial burnishing operations.

14 Claims, 10 Drawing Figures

BURNISHING FLOOR POLISHER

BACKGROUND AND SUMMARY

The invention relates to heavy duty industrial type floor polishers, particularly those used in burnishing operations.

In a burnishing operation, water is driven out of the finish on the floor, compacting the polymers in tight relation. The tighter and compacter the polymers, the higher the shine and the greater the durability of the finish on the floor. Burnishing is a dry operation which frictionally heats the finish on the floor surface and redistributes same, providing an extremely uniform, level and even surface. Moisture is evaporated by the frictional heat, and the removal of such moisture enables greater compacting. This resurfacing of the floor by friction, and polymer compression, is in contrast to systems where the finish is scrubbed off and then a new layer applied.

The present invention provides a burnishing floor polisher which is particularly characterized by its durability. Previous burnishing floor polishers have been subject to unacceptably high frequencies of mechanical breakdown and failure, with the resultant high percentage down-time being particularly objectionable. The present invention provides a high quality, heavy duty floor polisher which can withstand the high demands of burnishing.

The present invention further provides a floor polisher having particularly desirable operational characteristics, including ease of operator control, and a more effective burnishing frictional engagement with the floor for a higher quality finish.

DETAILED DESCRIPTION

Figure 1:
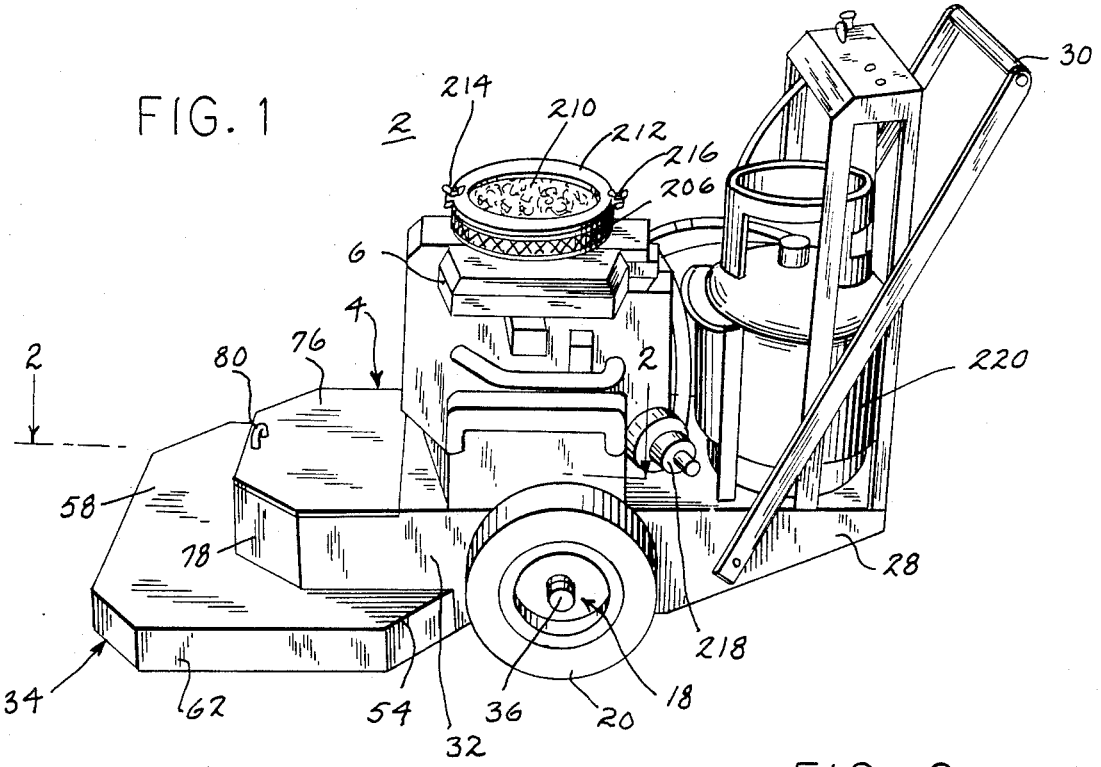
FIG. 1 is a perspective view of a floor polisher in accordance with the invention.
Figure 2:
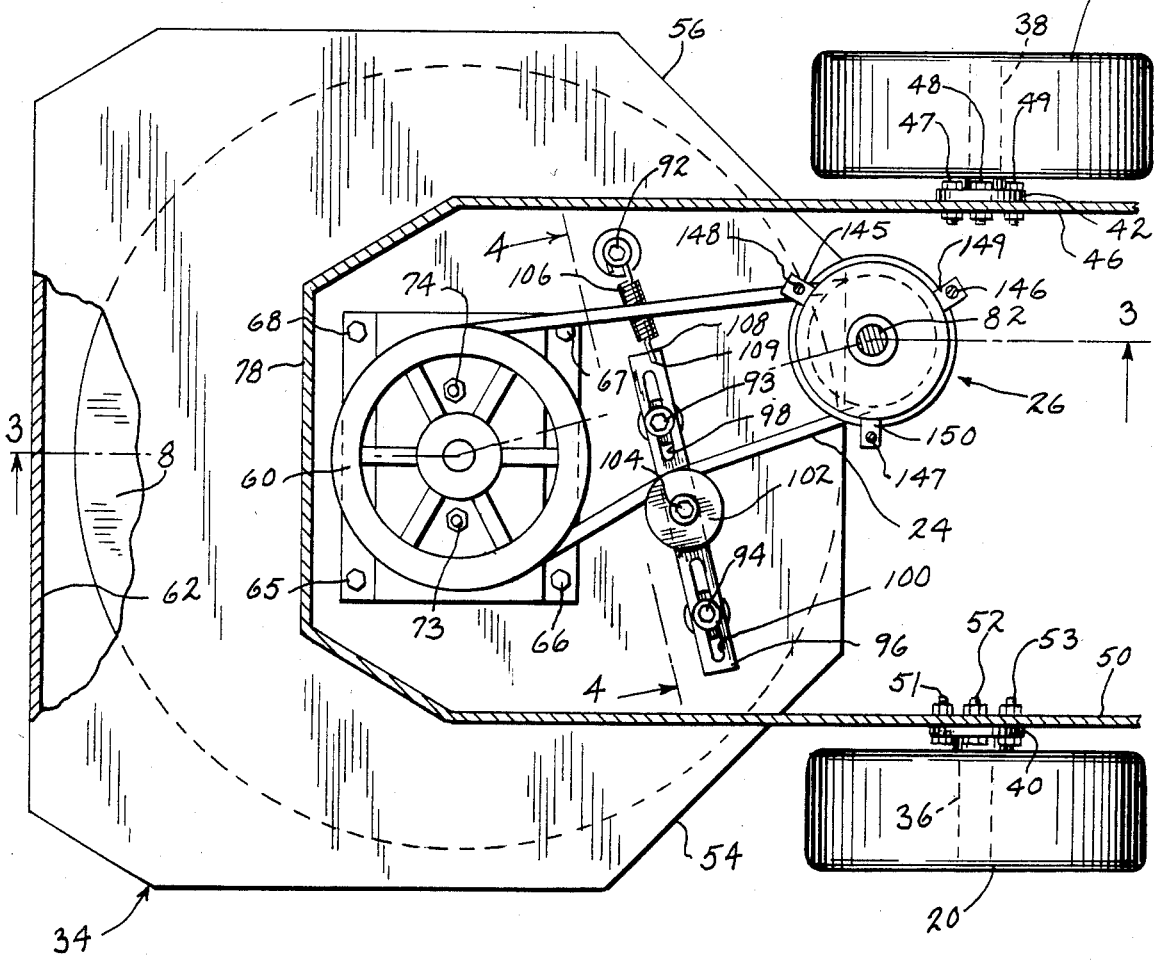
FIG. 2 is a sectional view taken along line 2—2 of FIG. 1.
Figure 3:
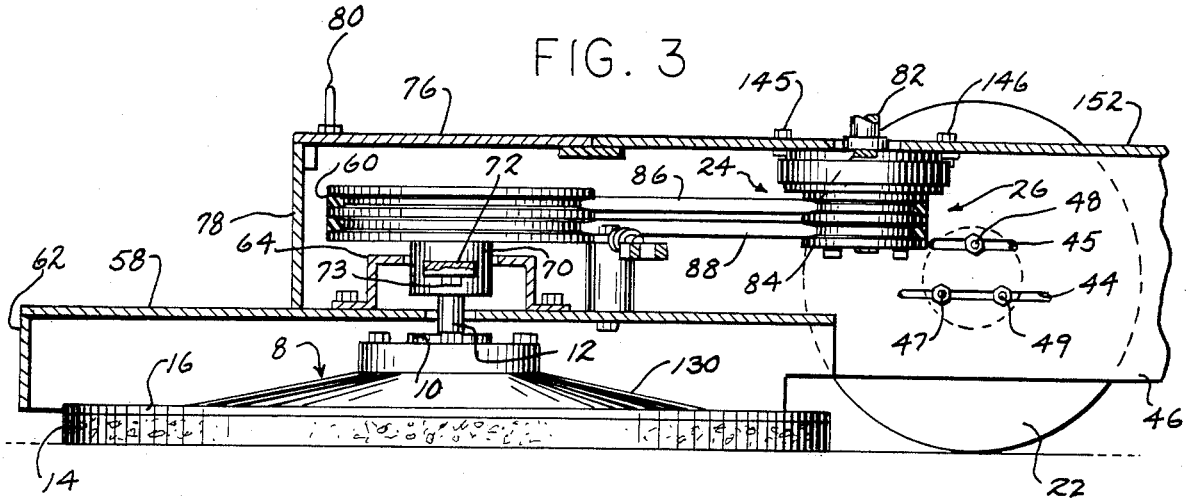
FIG. 3 is a sectional view taken along line 3—3 of FIG. 2.

There is shown in FIG. 1 a floor polisher 2 having a frame 4 mounting an internal combustion engine 6 thereon, such as Briggs & Stratton Model Series 421700 to 421799 or 422700 to 422799. Rotary brush means 8, FIG. 3, is mounted through a universal joint 10 to a rotary shaft 12 supported from the frame. Brush means 8 includes a pad 14, such as hogs hair, secured to the underside of annular flange 16 by Swiss spear type attachment, which is similar to velcro but on a larger scale. Axle means 18, FIG. 1, is mounted to the frame, and left and right wheels 20 and 22, FIG. 2, are mounted to the axle means for supporting and rolling the frame forward-rearward on the floor. Coupler means 24, such as a pulley and drive belt system, FIGS. 2 and 3, to be described, couple the engine to rotary shaft 12 for driving rotary brush 8 through universal joint 10. An electromagnetic clutch 26 is provided for engaging and disengaging the coupler from the engine.

Frame 4 has a rear section 28 having operator handle means 30 for pushing the frame, a central section 32 mounting engine 6 and axle means 18, and a front section 34 housing rotary brush 8. Axle means 18 includes left and right axles 36 and 38, FIG. 2, mounted by respective left and right axle plates 40 and 42 to central frame section 32, and means for adjustably locating the axle plates forward-rearward along central frame section 32, for balancing frame 4 forward-rearward about left and right wheels 20 and 22 as a fulcrum. This adjustment is preferably provided by longitudinal forward-rearward slots 44 and 45, FIG. 3, through a right sidewall 46 depending vertically from the central frame section and through which bolts such as 47–49 extend from right axle plate 42 and tightened to the frame by respective nuts. The central frame section likewise has a vertical left sidewall 50 with like slots therethrough for receiving bolts such as 51–53 from left axle plate 40 for adjustably moving left axle 36 forward-rearward. The longitudinal slots may alternatively be formed in the axle plates. Forward-rearward balancing of the frame is particularly desirable to facilitate ease of control by the operator, in view of the substantial weight of the machine which in turn is desirable for burnishing operations.

Axles 36 and 38 extend respectively leftwardly and rightwardly beyond central frame section 32 and mount respective wheels 20 and 22 outboard of central frame section 32. Front frame section 34 is laterally flared at 54 and 56 to extend leftwardly outboard of left wheel 20 and rightwardly outboard of right wheel 22. Front frame section 34 has a first lower level deck 58, FIGS. 1 and 3, mounting a front pulley 60 from which rotary shaft 12 depends. Deck 58 has depending sideskirts such as 62 partially enclosing rotary brush 8. Front pulley 60 is above deck 58, and rotary shaft 12 extends downwardly through deck 58. Universal joint 10 is mounted to rotary shaft 12 below deck 58, and rotary brush 8 is mounted to universal joint 12, to be described more fully hereinafter in conjunction with FIG. 9. A pulley-holder raised-subframe 64 is bolted, as at bolts 65–68, to the top of deck 58, and an annular collar 70 extends vertically therethrough and is mounted by lateral ears such as left ear 72 bolted, as at bolt 73 for the left ear and bolt 74 for the right ear, to the underside of raised-subframe 64 in rigid stationary relation. Rotary shaft 12 is supported and journaled in stationary collar 70, and pulley 60 is mounted to the upper end of shaft 12. Front frame section 34 has a second upper level horizontal deck 76 over front pulley 60 and having depending sideskirts such as 78 extending down to lower deck 58 to enclose front pulley 60. Deck 76 may be in the form of a removable trap door with handle 80, providing access.

Figure 4:
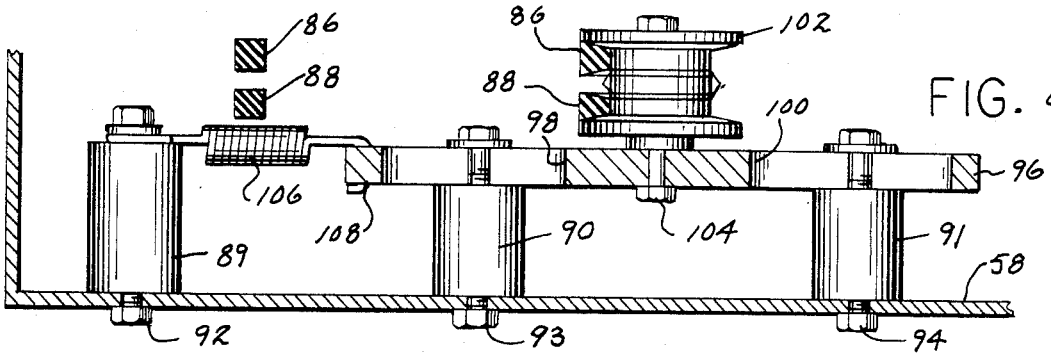
FIG. 4 is a sectional view taken along line 4—4 of FIG. 2.

Engine 6 has an output driveshaft 82 extending downwardly in central frame section 32 below the level of upper deck 76 of the front frame section, and has a central pulley 84, FIG. 3, mounted thereto substantially horizontally coplanar with front pulley 60 and connected thereto by a pair of drive belts 86 and 88. Belt tensioning means are provided for holding the belts tight. Three vertical spacers 89–91, FIG. 4, are mounted to the upper surface of lower deck 58 by respective bolts 92–94. A lateral slide plate 96 rests on spacers 90 and 91 and has generally lateral left-right slots 98 and 100, FIGS. 2 and 4, therethrough which receive respective bolts 93 and 94 which limit the lateral left-right movement of slide bar 96. Idler pulley 102 is mounted to slide bar 96 by bolt 104 for engaging belts 86 and 88. A coiled tension spring 106 is mounted to the top of bolt 92 on top of vertical spacer 89 and has a hook 108 at its right end in hole 109 in slide bar 96, to bias slide bar 96 leftwardly as seen in FIG. 4. This biases pulley 102 inwardly as seen in FIG. 2 to tension belts 86 and 88.

Figure 7:
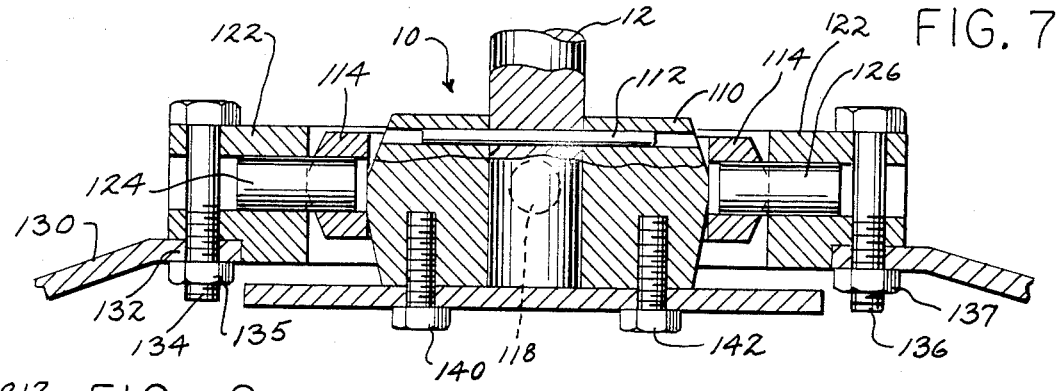
FIG. 7 is an isolated sectional view of a portion of FIG. 3.
Figure 9:
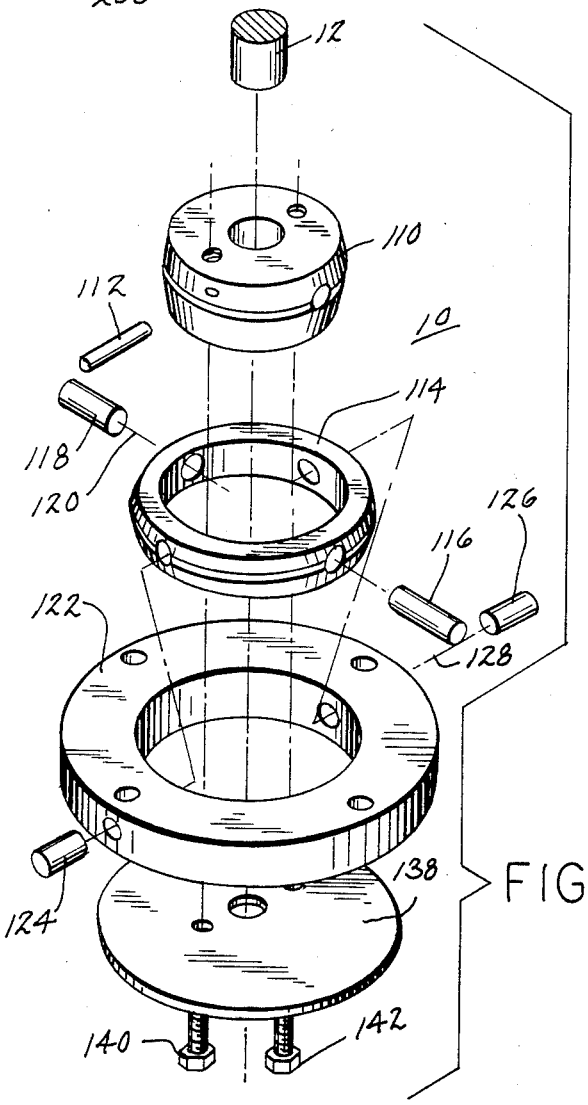
FIG. 9 is an exploded perspective view of the structure of FIG. 7.

Universal joint 10 of FIG. 3 is illustrated in FIGS. 7 and 9. A first annular ring 110 is concentrically and nonrotatably mounted to shaft 12 by staking pin 112 extending through each. A second annular ring 114 is concentrically mounted to first annular ring 110 by a pair of distally opposed transverse radial pins 116 and 118 to permit tilting of second annular ring 114 relative to first annular ring 110 about a first horizontal axis 120. A third annular ring 122 is concentrically mounted to second annular ring 114 by a second pair of distally opposed transverse radial pins 124 and 126, 90° offset from the first pair of transverse pins 116 and 118, to permit tilting of third annular ring 122 relative to second annular ring 114 about a second horizontal axis 128, 90° offset from horizontal axis 120. Rotary brush 8, FIG. 3, includes outer peripheral horizontal annular flange portion 16, which extends radially inwardly and frustoconically upwardly at 130, FIGS. 3 and 7, to inner horizontal annular flange portion 132 mounted to the underside of third annular ring 122, as by four bolts and nuts, and lock washers if desired, two of which bolts 134 and 136 and nuts 135 and 137 are shown. A bottom protective cover plate 138 is mounted by bolts 140 and 142 to the underside of first annular ring 110. The structure shown enables flush engagement between pad 14 of brush means 8 and the floor, notwithstanding tilting of frame 4.

Figure 5:
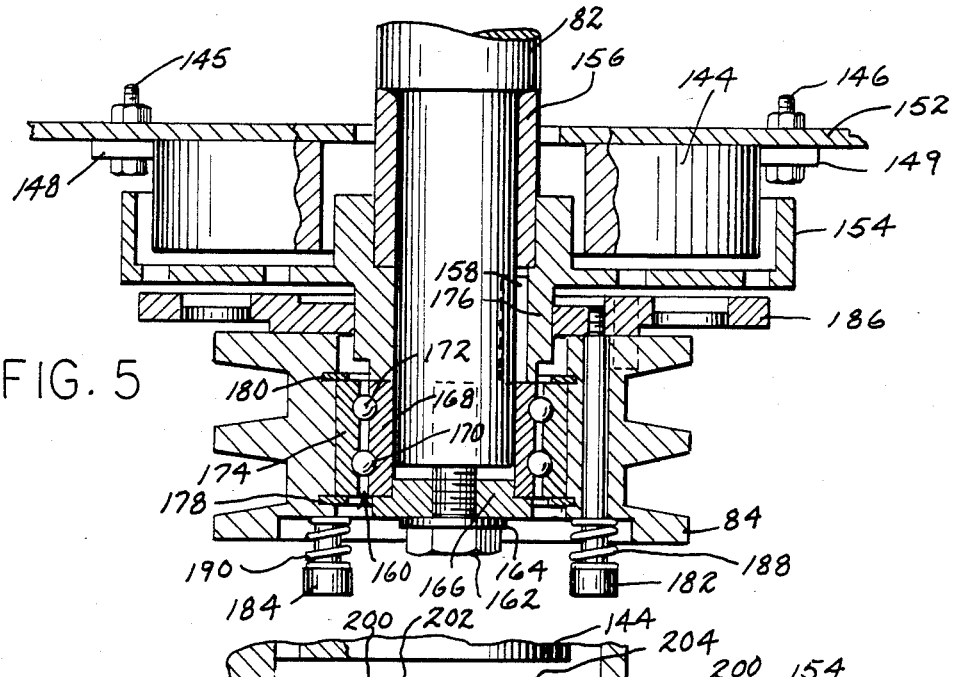
FIG. 5 is an isolated sectional view of a portion of FIG. 3.
Figure 6:
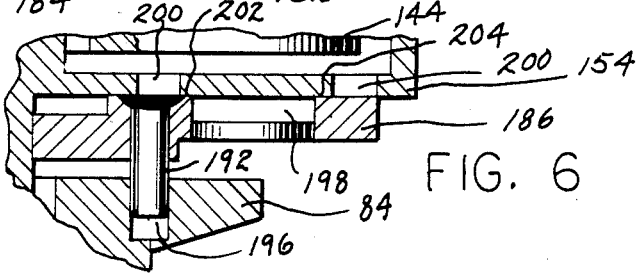
FIG. 6 is an isolated sectional view of a portion of FIG. 5.
Figure 10:
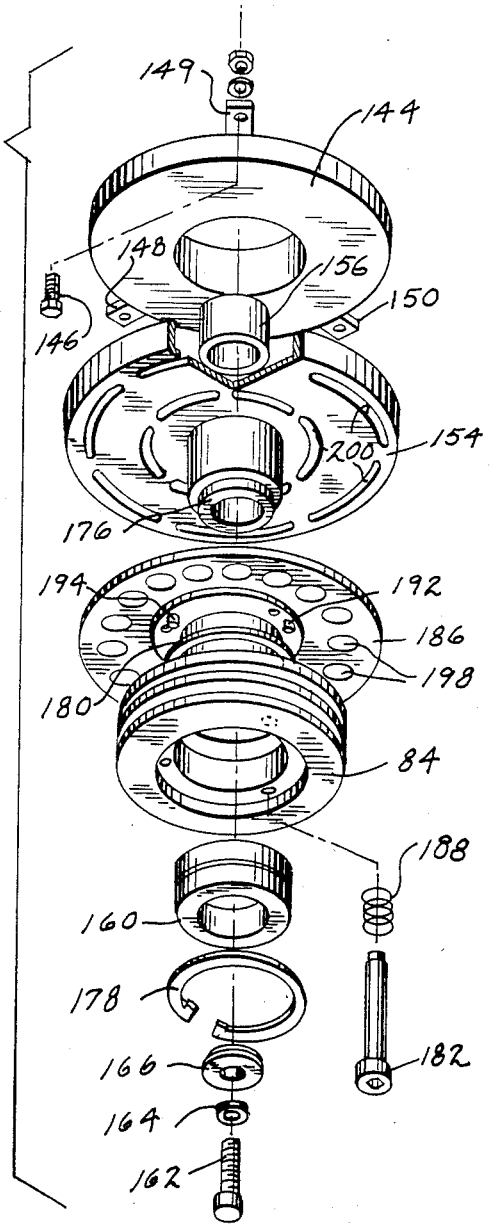
FIG. 10 is an exploded perspective view of the structure of FIG. 5.

Electromagnetic clutch means 26 is shown in FIGS. 5, 6 and 10. A stationary electromagnet 144 is mounted to central frame section 32 concentrically about output driveshaft 82 of the engine extending therethrough. Electromagnet 144 is mounted by bolts 145–147 through ears 148–150 to the underside of a horizontal deck portion 152 of central section 32 which is coplanar with front top deck section 76. A magnetically permeable annular cup-shaped member 154 is fixedly mounted to output driveshaft 82 to rotate therewith and in close proximity to electromagnet 144 to couple magnetic flux lines therebetween. A journal bearing 156 is provided between shaft 82 and member 154, and member 154 is keyed to shaft 82 at 158. Pulley 84 is concentrically mounted to driveshaft 82 and bearing means 160 permits pulley 84 to remain stationary while output driveshaft 82 rotates therein.

An axial end bolt 162 is threaded into the bottom end of driveshaft 82 and has a washer 164 holding an axial end cap 166 which in turn bears against the inner race 168 of ball bearing 160 which has for example a pair of balls 170 and 172 between inner race 168 and outer race 174. Axial end cap 166 presses inner race 168 upwardly against axial extension sleeve 176 of member 154. A pair of compression retention rings 178 and 180 retain pulley 84 on outer race 174 and prevent axial movement therebetween.

Pulley 84 has three bolts, two of which are shown at 182 and 184, extending therethrough and threaded into a magnetically permeable plate 186 such that the latter is nonrotatably mounted to pulley 84 axially between pulley 84 and cup-shaped member 154. Plate 186 is axially movable between a first position, FIG. 5, axially spaced from cup-shaped member 154, and a second position, FIG. 6, engaging cup-shaped member 154 along a radial plane and rotatably driven by member 154 which in turn drives pulley 84. Plate 186 is magnetically attracted into engagement with cup-shaped member 154 in response to flux from the electromagnet. Three compression coil springs, two of which are shown at 188 and 190 around respective bolts 182 and 184, bear between pulley 84 and the lower enlarged head portions of the respective bolts to bias such bolts downwardly and hence bias plate 186 axially to the position shown in FIG. 5 away from member 154. Axial pins such as 192 and 194 from plate 186 extend between pulley 84 and plate 186 for preventing relative rotation therebetween and for guiding axial movement of plate 186, for example as shown in FIG. 6 where pin 192 of plate 196 is received in axial slot 196 of pulley 84 for aligned axial guidance. In the actuated position shown in FIG. 6, coupling means 24 is engaged with the engine output and drives rotary shaft 12.

Magnetic flux is directed in cup-shaped member 154 and plate 186 outwardly in selected paths to areas of concentrated flux density radially spaced from output driveshaft 82 to enhance axially attractive magnetic force on plate 186. Flux is blocked along paths other than the selected paths and redirected along such selected paths. Plate 186 and cup-shaped member 154 each have cut-out apertures therethrough such as 198 and 200, respectively, substantially non-aligned with each other such that apertures 198 in plate 186 axially face solid portions of cup-shaped member 154, and apertures 200 in cup-shaped member 154 axially face solid portions of plate 186. The solid portions of plate 186 and cup-shaped member 154 have limited areas of axial overlap, such as 202 and 204, FIG. 6, concentrating flux density therebetween. This concentration of flux density at points radially removed from driveshaft 82 effectively prevents high flux concentrations at radially inward sections and instead spreads the flux out and enhances positive clutch action.

Figure 8:
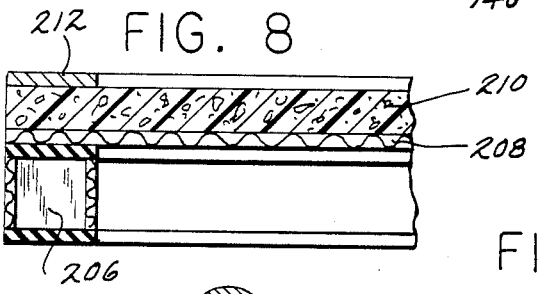
FIG. 8 is an isolated sectional view of a portion of FIG. 1.

FIG. 8 shows the filtering arrangement for the engine, including an annular automotive type air filter 206 supporting an expanded wire metal screen 208 and open cell sponge member 210, and topped by annular ring 212, clamped by side clamps 214 and 216. The fuel system for the engine is standard and may include a Beam Products Manufacturing Company Model 50 LP gas regulator 218.

It is recognized that various alternatives and modifications are possible within the scope of the appended claims.

I claim:

1. A floor polisher comprising:

a frame;

engine means mounted on said frame;

rotary brush means mounted to a rotary shaft driven by said engine means;

axle means mounted to said frame;

left and right wheels mounted to said axle means for supporting and rolling said frame forward-rearward on the floor; and means for adjustably moving said axle means forward-rearward relative to said frame for balancing said frame forward-rearward about said left and right wheels as a fulcrum;

wherein:

said frame has a rear section having operator handle means for pushing said frame;

said frame has a central section mounting said engine and said axle means; and said frame has a front section housing said rotary brush means;

said central frame section has generally vertical left and right sidewalls;

said axle means comprises left and right axles mounted by respective left and right axle plates to respective said left and right sidewalls of said central frame section, said left and right wheels mounted on respective said left and right axles;

one of said left axle plate and said left sidewall of said central frame section including longitudinal forward-rearward slots formed therethrough for mounting the other of said left axle plate and left sidewall of said central frame section and for adjusting the relative forward-rearward location thereof;

one of said right axle plate and said right sidewall of said central frame section including longitudinal forward-rearward slots formed therethrough for mounting the other of said right axle plate and right sidewall of said central frame section and for adjusting the relative forward-rearward location thereof.

2. A floor polisher comprising:

a frame;

engine means mounted on said frame;

rotary brush means mounted to a rotary shaft driven by said engine means;

axle means mounted to said frame;

left and right wheels mounted to said axle means for supporting and rolling said frame forward-rearward on the floor; and means for adjustably moving said axle means forward-rearward relative to said frame for balancing said frame forward-rearward about said left and right wheels as a fulcrum;

wherein:

said frame has a rear section having operator handle means for pushing said frame;

said frame has a central section mounting said engine from said axle means; and said frame has a front section housing said rotary brush means;

said engine means has an output driveshaft at said central frame section and including means coupling said output driveshaft to said rotary shaft at said front frame section;

and comprising in combination electromagnetic clutch means for engaging and disengaging said coupling means with said output driveshaft of said engine means;

wherein said coupling means comprises:

central pulley means mounted to said output driveshaft;

front pulley means mounted to said rotary shaft; and belt means extending around said central and front pulley means;

wherein said electromagnetic clutch means comprises:

a stationary electromagnet mounted to said central frame section concentrically about said output driveshaft extending therethrough;

a magnetically permeable annular cup-shaped member fixedly mounted to said output driveshaft to rotate therewith and in close proximity to said electromagnet to couple magnetic flux lines therebetween;

means mounting said central pulley means concentrically to said output driveshaft through bearing means permitting said central pulley means to remain stationary while said output drive-shaft rotates therein;

a magnetically permeable plate nonrotatably mounted to said pulley means axially between said pulley means and said cup-shaped member, said plate being axially movable between a first position axially spaced from said cup-shaped member and a second position engaging said cup-shaped member along a radial plane and rotatably driven thereby which in turn drives said central pulley means, said plate being magnetically attracted into engagement with said cup-shaped member in response to flux from said electromagnet; and means axially biasing said plate to said first position away from said cup-shaped member.

3. The invention according to claim 2 comprising axial pin means between said central pulley means and said plate for preventing relative rotation therebetween and for guiding said axial movement of said plate.

4. The invention according to claim 2 comprising flux directing means formed in said cup-shaped member and said plate directing flux outwardly in selected paths to areas of concentrated flux density radially spaced from said output driveshaft to enhance axially attractive magnetic force on said plate, said flux directing means blocking flux along paths other than said selected paths and redirecting said last mentioned flux to said selected paths.

5. A floor polisher comprising:

a frame;

wheel means mounted to said frame for supporting and rolling said frame on the floor;

engine means mounted on said frame;

rotary brush means mounted through a universal joint to a rotary shaft driven by said engine means, enabling flush engagement between said brush means and the floor notwithstanding tilting of said frame;

wherein said universal joint comprises:

a first annular ring concentrically mounted to said rotary shaft and nonrotatable relative thereto;

a second annular ring concentrically mounted to said first annular ring by a pair of distally opposed transverse radial pins to permit tilting of said second annular ring relative to said first annular ring about a first horizontal axis;

a third annular ring concentrically mounted to said second annular ring by a second pair of distally opposed transverse radial pins, 90° offset from said first pair of transverse pins, to permit tilting of said third annular ring relative to said second annular ring about a second horizontal axis 90° offset from said first horizontal axis;

a horizontal cover plate mounted to said first annular ring and extending radially to overlap and be vertically spaced from said third annular ring in a non-tilted position of the latter and be engaged by said third annular ring in the maximum tilted position of the latter to limit the degree of tilting;

and wherein said rotary brush means is mounted to said third annular ring.

6. The invention according to claim 5 wherein:

said wheel means includes left and right wheels mounted on respective left and right axles mounted by respective left and right axle plates to said frame, and including means for adjustably moving said left and right axle plates forward-rearward along said frame for balancing said frame;

said engine means has an output driveshaft, and including means coupling said output driveshaft to said rotary shaft, said coupling means comprises:

first pulley means mounted to said output driveshaft;

second pulley means mounted to said rotary shaft; and belt means extending around said first and second pulley means.

7. The invention according to claim 6 wherein:

said frame has a rear section having operator handle means for pushing said frame;

said frame has a central section mounting said engine and said left and right axle plates;

said frame has a front section housing said rotary brush means;

said front frame section has a first lower level horizontal deck mounting said second pulley from which said rotary shaft depends, said deck having depending side skirts partially enclosing said rotary brush, said second pulley being above said deck and said rotary shaft extending downwardly through said deck, said rotary brush means being mounted to said rotary shaft below said deck;

said front frame section has a second upper level horizontal deck over said second pulley and having depending side skirts extending down to said lower deck to enclose said pulley;

said third annular ring is below said first lower deck, and said rotary brush means is mounted to the underside of said third annular ring.

8. A floor polisher comprising:

a frame;

wheel means mounted to said frame for supporting and rolling said frame on the floor;

engine means mounted on said frame;

rotary brush means supported from said frame;

means coupling said engine means to said rotary brush means for driving the latter; and electromagnetic clutch means for engaging and disengaging said coupling means with said engine means.

9. A floor polisher comprising:

a frame;

wheel means mounted to said frame for supporting and rolling said frame on the floor;

engine means mounted on said frame;

rotary brush means supported from said frame;

means coupling said engine means to said rotary brush means for driving the latter; and electromagnetic clutch means for engaging and disengaging said coupling means with said engine means;

wherein said engine means has an output driveshaft, and wherein said electromagnetic clutch means comprises:

a stationary electromagnet mounted to said frame concentrically about said output driveshaft extending therethrough;

a magnetically permeable annular cup-shaped member fixedly mounted to said output driveshaft to rotate therewith and in close proximity to said electromagnet to couple magnet flux lines therebetween;

means mounting said coupling means concentrically to said output driveshaft through bearing means permitting said coupling means to remain stationary while said output driveshaft rotates therein;

a magnetically permeable plate nonrotatably mounted to said coupling means axially between said coupling means and said cup-shaped member, said plate being axially movable between a first position axially spaced from said cup-shaped member and a second position engaging said cup-shaped member along a radial plane and rotatably driven thereby which in turn drives said coupling means, said plate being magnetically attracted into engagement with said cup-shaped member in response to flux from said electromagnet; and means axially biasing said plate to said first position away from said cup-shaped member.

10. The invention according to claim 9 comprising axial pin means between said coupling means and said plate for preventing relative rotation therebetween and for guiding said axial movement of said plate.

11. The invention according to claim 9 comprising flux directing means formed in said cup-shaped member and said plate directing flux outwardly in selected paths to areas of concentrated flux density radially spaced from said output driveshaft to enhance axially attractive magnetic force on said plate, said flux directing means blocking flux along paths other than said selected paths and redirecting said last mentioned flux to said selected paths.

12. The invention according to claim 11 wherein said plate and said cup-shaped member each have cut-out apertures therethrough substantially nonaligned with each other such that apertures in said plate axially face solid portions of said cup-shaped member, and apertures in said cup-shaped member axially face solid portions of said plate, solid portions of said plate and said cup-shaped member having limited areas of axial overlap concentrating flux density therebetween.

13. A floor polisher comprising in combination:

a frame;

engine means mounted on said frame;

rotary brush means mounted through a universal joint to a rotary shaft supported from said frame, enabling flush engagement between said brush means and the floor notwithstanding tilting of said frame;

axle means mounted to said frame;

left and right wheels mounted to said axle means for supporting and rolling said frame forward-rearward on the floor;

means coupling said engine means to said rotary shaft for driving said rotary brush means through said universal joint;

electromagnetic clutch means for engaging and disengaging said coupling means with said engine means;

wherein:

said frame has a rear section having operator handle means for pushing said frame;

said frame has a central section mounting said engine and said axle means;

said frame has a front section housing said rotary brush means;

said axle means comprises left and right axles mounted by respective left and right axle plates to said central frame section, and means for adjustably locating said axle plates forward-rearward along said central frame section;

said axles extend respectively leftwardly and rightwardly beyond said central frame section and mount respective said wheels outboard of said central frame section;

said front frame section is laterally flared outwardly to extend leftwardly outboard of said left wheel and rightwardly outboard of said right wheel;

said front frame section has a first lower level horizontal deck mounting a front pulley from which said rotary shaft depends, said deck having depending side skirts partially enclosing said rotary brush means, said front pulley being above said deck and said rotary shaft extending downwardly through said deck, said universal joint being mounted to said rotary shaft below said deck, and said rotary brush means being mounted to said universal joint;

said front frame section has a second upper level horizontal deck over said front pulley and having depending side skirts extending down to said lower deck to enclose said front pulley;

said engine means has an output driveshaft extending downwardly in said central frame section below the level of said second upper deck of said front frame section, and has a central pulley mounted thereto substantially horizontally coplanar with said front pulley and connected thereto by one or more drive belts.

14. A floor polisher comprising:

a frame;

wheel means mounted to said frame for supporting and rolling said frame on the floor;

engine means mounted on said frame and having an output rotary driveshaft;

rotary brush means supported from said frame by a second rotary shaft;

means coupling said engine means to said rotary brush means for driving the latter; and electromagnetic clutch means for engaging and disengaging said coupling means with said engine means, comprising a double ball bearing having an inner race engaging one of said rotary shafts and an outer race engaging a double belt pulley and permitting free relative rotary motion between said one shaft and said double belt pulley when said coupling means is disengaged with said engine means.

* * * * *